United States Patent [19]

Naiki

[11] Patent Number: 4,800,318

[45] Date of Patent: Jan. 24, 1989

[54] ELECTRODE ASSEMBLY FOR ELECTROSTATIC LENS OF ELECTRON GUN

[75] Inventor: Kazuaki Naiki, Tokyo, Japan

[73] Assignee: NEC Corporation, Japan

[21] Appl. No.: 13,676

[22] Filed: Feb. 12, 1987

[30] Foreign Application Priority Data

Feb. 12, 1986 [JP] Japan ..... 61-29363
Sep. 10, 1986 [JP] Japan ..... 61-214431

[51] Int. Cl.[4] ..... H01J 29/58
[52] U.S. Cl. ..... 313/414; 313/449
[58] Field of Search ..... 313/414, 449, 452, 460

[56] References Cited

U.S. PATENT DOCUMENTS 4,668,892 5/1987 Peels ..... 313/414

FOREIGN PATENT DOCUMENTS 5630239 3/1981 Japan ..... 313/414
60-9036 1/1985 Japan .

*Primary Examiner*—David K. Moore

*Assistant Examiner*—K. Wieder

*Attorney, Agent, or Firm*—Laff, Whitesel, Conte & Saret

[57] ABSTRACT

An electrode assembly for an electrostatic lens of the in-line type electron gun for a color cathode ray tube, includes a pair of tubular electrodes arranged in axially opposing relation. Each of the tubular electrodes includes a main tubular electrode member closed at its one end by an end wall which has an aperture of the configuration obtained by partially overlapping a plurality of circular openings arranged in an in-line manner. An auxiliary electrode member is fitted into the main electrode member. The auxiliary electrode member has an end wall positioned separately from the end wall of the main electrode member by a predetermined distance. The end wall of the auxiliary electrode member is formed with a plurality of independent collars projecting therethrough in parallel to the axial direction of the respective circular openings of the overlapped-multicircle aperture and to superpose the corresponding circular openings of the overlapped-multicircle aperture in an axial direction.

12 Claims, 6 Drawing Sheets

ELECTRODE ASSEMBLY FOR ELECTROSTATIC LENS OF ELECTRON GUN

BACKGROUND OF THE INVENTION

1. Field of the Invention

The present invention relates to an electrode assembly for an electrostatic lens, and more particularly to an electrode assembly for an electrostatic lens which can be used in a color cathode ray tube having three in-line arranged electron guns.

2. Description of Related Art

One important factor which restricts resolution of cathode ray tubes is a spherical aberration of an electrostatic lens in cooperated in the cathode ray tube. For high resolution, it is required to enlarge an aperture of an electrode for an electrostatic lens so that the spherical aberration becomes small. However, in a color cathode ray tube having three in-line arranged electron guns associated with in-line arranged electrostatic lens, if the aperture diameter of the electrostatic lenses is simply increased, a "separation distance" between the centers of the apertures of the in-line arranged lenses must be increased. This will require an enlarged diameter of evacuated envelope neck accommodating the electron gun therein.

In general, increase of the separation distance will decrease convergence error in that three electron beams can be intersected on any point of a phosphor screen. Further, increase of the envelope neck requires a large deflection power. In order to enlarge the aperture of a main electrostatic lens without changing the separation distance of the main electrostatic lens and the envelope neck diameter in the in-line electron gun type cathode ray tube, the applicant has proposed in Japanese Patent Application Laid-open No. Sho 60-9036 an electrode for an electrostatic lens, which comprises a tubular portion closed at its one end and having the configuration obtained by laterally combining three in-line arranged circular cylinders in partially overlapped manner, the cylinders having an inner diameter larger than a predetermined separation distance, and three independent circular collars outwardly projecting from a bottom of the tubular portion.

Referring to FIGS. 1 to 3, there is shown the electrode proposed in the above Laid-open Japanese Patent Application for use in an electrode assembly for an electrostatic lens. FIG. 1 is a partially broken perspective view of the electrode disclosed in the above Japanese Patent Application, and FIGS. 2 and 3 are top view and sectional view of the tubular electrode shown in FIG. 1, respectively.

The shown electrode 10 includes a tube-shaped casing 12 of a substantially rectangular section having a pair of straight parallel long sides and a pair of arced short sides. The casing 12 has a flange 14 provided at its one end to extend outwardly. The flange 14 has a pair of support tags 16 each integrally formed at a center portion of the long side.

The casing 12 is closed at its other end by a first end wall 18, from which a tubular portion 20 projects towards the inside of the casing 12. The tubular portion 20 has a configuration obtained by laterally combining three in-line arranged circular cylinders 20R, 20G and 20B in a partially overlapped manner. Each of the cylinders 20R, 20G and 20B has an inner diameter $D_0$ larger than a given separation distance S. Further, the tubular portion 20 has a narrow portion 26 formed at a junction between each pair of adjacent cylinders 20R-20G and 20G-20B. Thus, the tubular portion 20 forms a concave space on the end wall 18.

The tubular portion 20 terminates at a second end wall 22 separate from the first end wall 18 by the distance $h_0$. The second end wall 32 has three independent collars 24R, 24G and 24B projecting therefrom toward the inside of the casing 12. These rollers 24R, 24G and 24B are coaxial with the cylinders 20R, 20G and 20B of the tubular portion 20, respectively, and have an inner diameter $D_1$ smaller than that of the cylinders 20R, 20G and 20B. The collars 24R, 24G and 24B has the section of a perfect circle and a height of $h_1$.

Turning to FIG. 4, there is shown in a sectional view an in-line type electron gun for a color cathode ray tube associated with a bi-potential type focusing elecrostatic lens which comprises a pair of tubular electrodes having the structure as mentioned above as a third grid electrode and a fourth grid electrode, the pair of tubular electrodes being located with the end walls 18 of the tubular electrodes facing each other.

The shown electron gun includes three cathodes 30R, 30G and 30B arranged in the in-line manner and containing a filament 30 therein, respectively. In front of the cathodes 30R, 30G and 30B, a first grid electrode $G_1$ and a second grid electrode $G_2$ are located in the named order, separately from the cathodes and from each other. These grid electrodes have three openings for passage of three electron beams emanated from the three cathodes 30R, 30G and 30B.

Further, in front of the second grid electrode $G_2$ there are located a third grid electrode $G_3$ and a fourth grid electrode $G_4$. The third grid electrode $G_3$ includes a first tubular electrode portion 34 having an end wall close to the second grid electrode $G_2$ and a second tubular electrode portion 36 having the structure shown in FIGS. 1 to 3. The first electrode portion 34 is bonded at its open end 34A to the flange 14 of the second tubular electrode portion 36.

With the above arrangement, the electron beam passage holes of the first to third grid electrodes $G_1$, $G_2$ and $G_3$ are coaxial to each other and are separated from each other by the separation distance S in each of the electrodes. But, the electron beam passage holes of the fourth grid electrode $G_4$ are separated from each other by a separation distance $S_1$ which is slightly larger than the separation distance S of the third grid electrode $G_3$. In addition, the center electron beam passage hole of the fourth grid electrode $G_4$ is coaxial to that of the third grid electrode $G_3$.

In the arrangement as mentioned above, the tubular electrodes 36 and 38 constitute a bi-potential type focusing electrostatic lens which has a very small spherical aberration by means of interaction between the tubular portion 20 composed of three combined large-diameter cylinders and the three independent collars 24R, 24G and 24B projecting from the tubular portion 20. In addition, the action of the lens in an arrangement direction of the three electrostatic lenses, i.e., in a horizontal direction is substantially equal to that of the lens in a direction perpendicular to the horizontal direction, so that the electrostatic lenses can have a very high resolution over a wide electron beam current range including a heavy electron beam current which will enlarge the diameter of the electron beam in the aperture of the electrostatic lens.

As mentioned above, the electrode 10 for the electrostatic lens has such a complicated structure that the three independent collars 24R, 24G and 24B are formed integrally of the bottom of the tubular portion 20 having the configuration obtained by laterally combining the three in-line arranged circular cylinders 20R, 20G and 20B in the partially overlapped manner. Therefore, it is very difficult to manufacture the electrode 10. Specifically, it is difficult to form the tubular portion 20 having the configuration of the three laterally overlapped cylinders and to form the three independent collars 24R, 24G and 24B of the height $h_1$ projected from the bottom of the tubular portion 20. Particularly, if the ratio of the height $h_1$ to the diameter $D_1$ of the independent collars becomes large, or if a high axial symmetry is required in each of the independent collars, difficulty in working the electrode will be increased still more.

Furthermore, if the inner diameter $D_0$ of the cylinders 20R, 20G and 20B defined in the tubular portion 20 is increased, the spherical aberration of the three in-line electrostatic lenses can be decreased. But, if the overlap degree of the increased diameter cylinders 20R, 20G and 20B is increased so as to prevent the increase of the separation distance, the inner distance G in the narrow portion 26 formed at the junction between each pair of adjacent cylinders 20R-20G and 20G-20B is increased. As a result, a center electrostatic lens of the three electrostatic lenses will have a large astigmatism in which the focusing action in a horizontal direction is smaller than that in a vertical direction. Accordingly, an optimum voltage for focus in the horizontal direction is required to be lower than that for focus in the vertical direction. Thus, the electron beam passing through the center electrostatic lens forms an oblong circle spot having a horizontal long axis on the phosphor screen. In other words, the resolution given by the center electrostatic lens becomes lower than that given by the side electrostatic lens.

SUMMARY OF THE INVENTION

Accordingly, it is an object of the present invention to provide an electrode assembly for an electrostatic lens in combination with an in-line type electron gun of a color cathode ray tube, which has overcome the inconveniences of the prior art.

Another object of the present invention is to provide an electrode assembly for an electrostatic lens which can be easily manufactured and which includes an overlappedmulticircle aperture having a configuration obtained by partially overlapping three in-line circular openings of a diameter larger than a given separation distance, and three independent circular apertures positioned axially apart from the overlapped-multicircle aperture.

Still another object of the present invention is to provide an electrode assembly of the above structure for an electrostatic lens, which can be easily manufactured without limitation in dimension of the respective apertures.

A further object of the present invention is to provide an electrode assembly for an electrostatic lens of the inline type electron gun, which electrode assembly has a simple structure and can be manufactured easily and inexpensively.

A still further object of the present invention is to provide an electrode assembly for an electrostatic lens of the in-line type electron gun, which provides a high resolution substantially equal between a center electrostatic lens and side electrostatic lenses.

Still another object of the present invention is to provide an electrode assembly for an electrostatic lens of the in-line type electron gun, which has a simple structure and can be manufactured easily and inexpensively.

The above and other objects of the present invention are achieved in accordance with the present invention by an electrode assembly for an electrostatic lens of the in-line type electron gun for a color cathode ray tube, which includes at least one tubular electrode, wherein the improvement is that the tubular electrode includes a main tubular electrode member closed at its one end by an end wall which has an aperture of the configuration obtained by partially overlapping a plurality of circular openings arranged in an in-line manner, and an auxiliary electrode member fitted into the main electrode member and having an end wall positioned separate from the end wall of the main electrode member at a predetermined distance, the end wall of the auxiliary electrode member being formed with a plurality of independent collars projecting therethrough in parallel to the axial direction of the respective circular openings of the overlapped-multicircle aperture and to superpose the corresponding circular openings of the overlapped-multicircle aperture in an axial direction.

With the above arrangement, an electrostatic lens is formed by one independent collar and a corresponding circular opening of the overlapped-multicircle aperture. But, the main electrode member having the overlapped-multicircle aperture and the auxiliary electrode member having the independent collars have a relatively simple configuration, respectively, and therefore, these members can be easily manufactured separately. In addition, the main electrode member and the auxiliary electrode member are not subjected to restriction in configuration other than the condition that the end wall of the auxiliary electrode member is positioned in place in the interior of the main electrode member. Accordingly, it is possible to increase the dimater of the respective circular openings forming the overlapped-multicircle aperture of the main electrode member and the length of the independent collars formed in the auxiliary electrode member.

In a preferred embodiment, the electrode assembly comprises a pair of tubular electrodes each having the main tubular electrode member and the auxiliary electrode member as mentioned above. The pair of tubular electrodes are located in such a manner that the end walls of the respective main tubular electrode members oppose to each other separately from each other. In this embodiment, the overlapped-multicircle aperture is composed of three circular openings, and the respective circular openings of the overlapped-multicircle aperture of each main tubular electrode member can be coaxial with the corresponding collars of the associated auxiliary electrode member. Alternatively, in any one of the pair of tubular electrodes, the center circular opening of the overlapped-multicircle aperture of the main tubular electrode member is coaxial with the center collar of the associated auxiliary electrode member, but the opposite side circular openings of the overlapped-multicircle aperture have their centers slightly shifted from the center axes of the corresponding collars of the associated auxiliary electrode member.

Furthermore, according to another feature of the present invention, a high potential side tubular electrode of the tubular electrode pair has its overlapped-multicircle aperture composed of circular openings whose diameter is smaller than that of the circular openings of the overlapped-multicircle aperture of a low potential side tubular electrode. In addition, in the high potential side tubular electrode, the center circular opening of the overlapped-multicircle aperture has a diameter smaller than that of the opposite side circular openings of the same overlapped-multicircle aperture.

With this arrangement, the three electrostatic lenses can provide an equal action in a horizontal direction along which the three electrostatic lenses are arranged and in a vertical direction perpendicular to the horizontal perpendicular to the horizontal direction. Thus, there can be obtained an in-line type electrostatic lens having a large aperture and capable of providing a high resolution.

The above and other objects, feature and advantages of the present invention will be apparent from the following description of preferred embodiments of the invention with reference to the accompanying drawings.

DETAILED DESCRIPTION OF THE PREFERRED EMBODIMENTS

Figure 1:
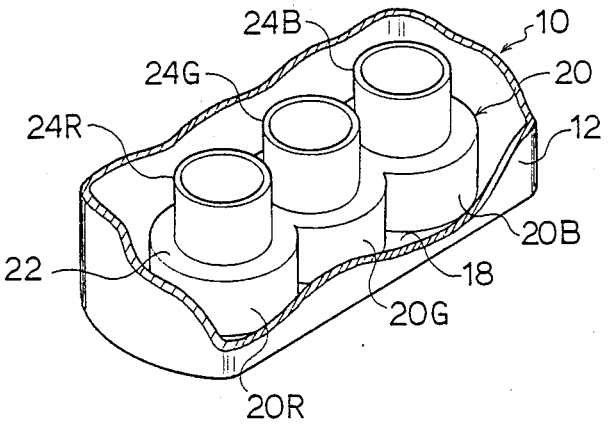
FIGURE 1 PRIOR ART
FIG. 1 is a partially broken perspective view of the conventional tubular electrode for use in an electrode assembly for an electrostatic lens of the in-line type electron gun for a color cathode ray rube.
Figure 2:
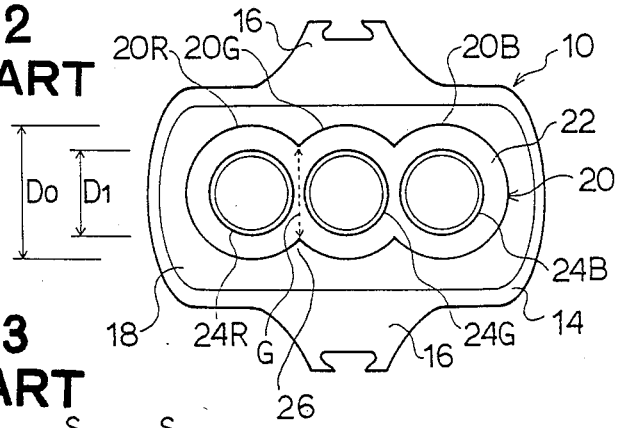
FIGURE 2 PRIOR ART
FIG. 2 is a top view of the tubular electrode shown in FIG. 1.
Figure 3:
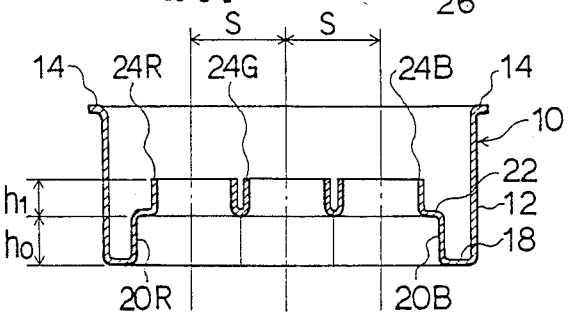
FIGURE 3 PRIOR ART
FIG. 3 is a sectional view of a tubular electrode shown in FIG. 1.
Figure 4:
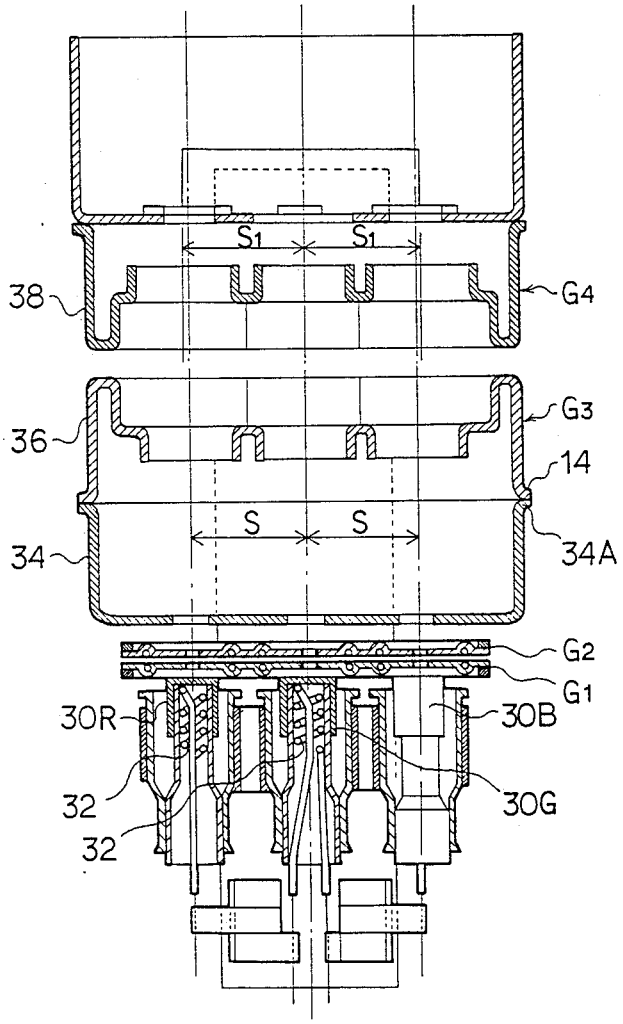
FIG. 4 is a sectional view of an electron gun assembly provided with the bi-potential type focusing electrostatic lens which comprises, as third and fourth grid electrodes, a pair of tubular electrodes shown in FIG. 1 located in opposing relation in an axial direction of the electron beams.
Figure 5:
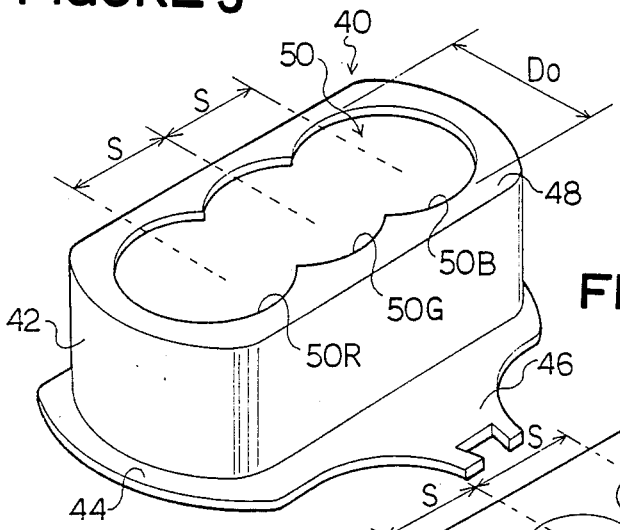
FIG. 5 is a perspective view of a main electrode member of a tubular electrode in accordance with the present invention, which can be used in an electrode assembly for an electrostatic lens of the in-line type electron gun for a color cathode ray tube.

Referring to FIG. 5, a main electrode member 40 of a tubular electrode in accordance with the present invention, which can be used in an electrode assembly for an electrostatic lens of the in-line type electron gun for a color cathode ray tube, comprises a tubular casing 42 of a substantially rectangular section having a pair of straight parallel long sides and a pair of arced short sides. The casing 42 has a flange 44 formed at is one end to extend outwardly. This flange 44 has a pair of support tags 46 each integrally outwardly projected from a center portion of the long side portion.

The other end of the casing 42 terminates at an end wall 48 extending inwardly. This end wall 48 is formed with an overlapped-multicircle aperture 50 having the configuration obtained by partially overlapping three inline arranged circular openings 50R, 50G and 50B. The centers of the three circular openings 50R, 50G and 50B are located on a straight line and are separated from each other by the same separation distance S. In addition, each of the openings 50R, 50G and 50B has an inner diameter $D_0$ larger than the separation distance S.

Figure 6:
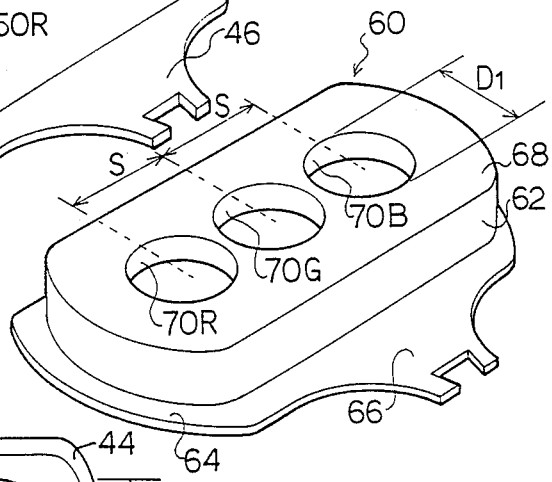
FIG. 6 is a perspective view of an auxiliary electrode member combined with the main electrode member for constituting one tubular electrode.

Turning to FIG. 6, an auxiliary electrode member 60 in combination with the main electrode member 40 to form one tubular electrode for an electrostatic lens, also comprises a tubular casing 62 of a substantially rectangular section having a pair of straight parallel long sides and a pair of arced short sides. The casing 62 has a flange 64 formed at its one end to extend outwardly. Further, the casing 42 has a pair of support tags 66 formed integrally with a center portion of the long side of the flange 64 to project outwardly. The casing 62 is slightly smaller than the casing 42, so that the auxiliary electrode member 60 is fitted into the main electrode member 40 as shown in FIG. 7.

Furthermore, the other end of the casing 62 terminates at an inwardly extending end wall 68, from which three independent circular collars 70R, 70G and 70B of a height $h_1$ project towards the interior of the casing 62. The center axes of these collars 70R, 70G and 70B lie in the same flat plane and are separated from each other by the same separation distance S as that of the circular openings 50R, 50G and 50B of the main electrode member 40. In addition, each of the collars 70R, 70G and 70B has an inner diameter $D_1$ smaller than the separation distance S. Further, the collars 70R, 70G and 70B are formed at such a position that the collars 70R, 70G and 70B are coaxial with the circular openings 50R, 50G and 50B of the main electrode member 40 when the auxiliary electrode member 60 is fitted into the main electrode member 40 as shown in FIG. 7. The casing 62 of the auxiliary electrode member 60 has such a height that the end wall 68 of the auxiliary electrode member 60 is positioned separately from the end wall 48 of the main electrode member 40 by a distance or height $h_0$ when the auxiliary electrode member 60 is fitted into the main electrode member 40 with the flange 64 being in contact with the flange 44 as shown in FIG. 7.

Figure 7:
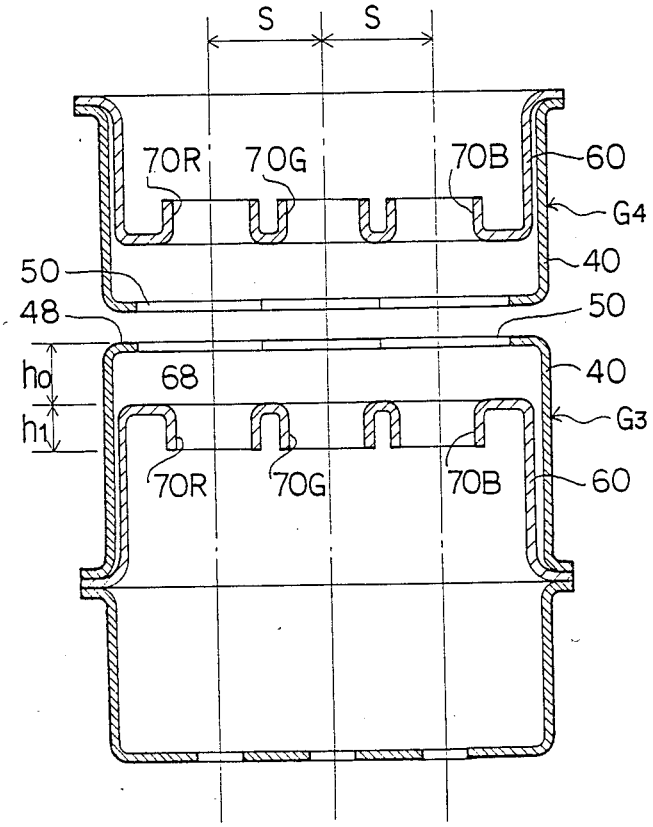
FIG. 7 is a sectional view of the bi-potential type focusing electrostatic lens comprising, as third and fourth grid electrodes, a pair of tubular electrodes each of which is constituted of the main electrode member shown in Figure 5 and the auxiliary electrode member shown in FIG. 6 and which are located in opposing relation in an axial direction of the electron beams.

Referring to FIG. 7, there is shown a bi-potential type focusing electrostatic lens comprising third and fourth grid electrodes $G_3$ and $G_4$, each of which is formed of the main electrode member 40 and the auxiliary electrode member 60 fitted thereinto, the overlapped-multicircle apertures of the two main electrode members opposing to each other separately from each other at a predetermined distance. In the bipotential type focusing electrostatic lens, the grid electrode $G_3$ is situated in a low porential side electrode, and the grid electrode $G_4$ is situated in a high potential electrode.

In each of the third and fourth grid electrodes $G_3$ and $G_4$, the overlapped-multicircle aperture 50 composed of large diameter openings formed in the main electrode member 40 will form three large aperture electrostatic lenses having only a small spherical aberration. On the other hand, if the independent collars 70R, 70G and 70B of the auxiliary electrode member 60 which provide independent small aperture electrostatic lenses has the height $h_1$ not less than one third of the inner diameter $D_1$ of the collar per se, an aberration caused by overlapping the large aperture electrostatic lenses can be removed. Thus, as a composite effect of the overlapped large aperture in-line electrostatic lenses and the independent small aperture electrostatic lenses, three large aperture electrostatic lenses of a very small aberration are equivalently formed between the third and fourth grid electrodes $G_3$ and $G_4$.

The applicant has found from experiments and computer simulations that if the feature $h_0$ between the end wall 68 of the auxiliary electrode member 60 and the end wall 48 of the main electrode member 40 in the third grid electrode $G_3$ is selected to have a value in the range of one fifth to three fifths of the inner diameter $D_0$ of the circular openings of the overlapped-multicircle aperture 50 (0.2 $D_0$ to 0.6 $D_0$), an optimum convergent characteristics can be obtained.

In the electrode assembly for an electrostatic lens as mentioned above, a large diameter electrostatic lens can be formed by only perforating the end wall 48 of the main electrode member 40 to form the overlapped-multicircle aperture 50 having the circular openings of the diameter $D_0$ larger than the separation distance S. Namely, it is not necessary to form a side wall surrounding and defining the overlapped-multicircle aperture. Therefore, the overlapped-mutlicircle aperture can be very easily formed, and so, the main electrode member 40 is greatly suitable to mass production. Furthermore, since a side wall joining between the overlapped-multicircle aperture 50 and the independent collars 70R, 70G and 70B is not required, the circular openings of the overlapped-multicircle aperture can have any diameter less than the length of the short side of the end wall 48, without restriction of dimension caused by formation of the independent collars in the case of the above side wall being required.

On the other hand, the auxiliary electrode member 60 is formed independently of the main electrode member 40 having the overlapped-multicircle aperture. Therefore, the distance $h_0$ between the end walls 48 and 68, and the height $h_1$ and the inner diameter $D_1$ of the independent collars 70R, 70G and 70B can be determined without being subjected to the configuration and dimension of the overlapped-multicircle aperture 50. Accordingly, the auxiliary electrode member can be easily manufactured in a mass production manner.

Figure 7A:
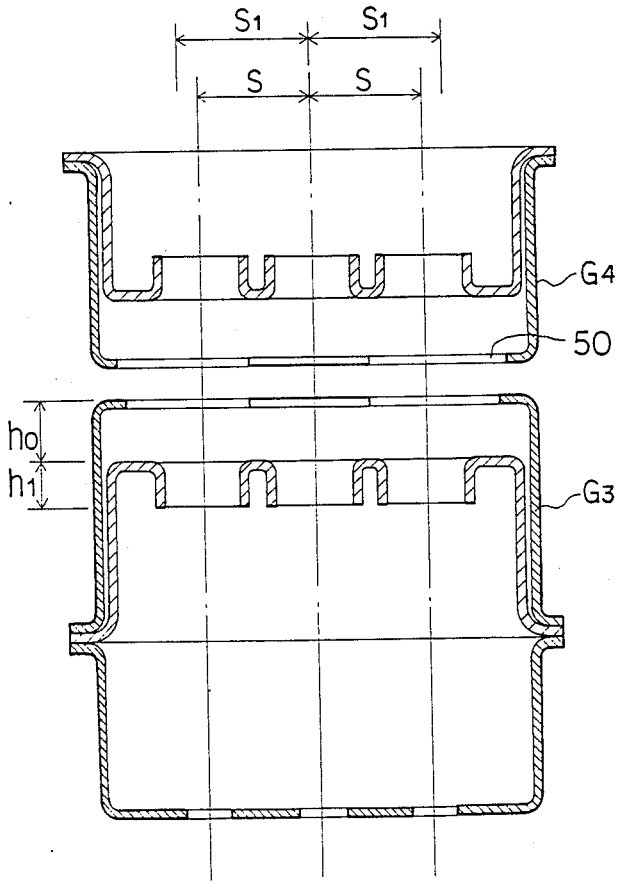
FIG. 7A is a view similar to FIG. 7 but showing a modification of the electrostatic lens shown in FIG. 7.

In the electrode assembly for electrostatic lens shown in FIG. 7, the separation distance S in the third grid electrode $G_3$ is the same as that of the fourth grid electrode $G_4$. However, in actual color cathode ray tube incorporating therein the in-line type electron gun, the separation distance is made slightly larger in any one of the overlapped-multicircle aperture 50 and the independent collars 70R, 70G and 70B of the fourth grid electrode $G_4$ than the separation distance S in the third grid electrode $G_3$ so that the passage of opposite side electron beams of the three electron beams is electrostatically deflected a little, with the result that the three electron beams passing in parallel through the third grid electrode $G_3$ are converged on one point of a phosphor screen (not shown). FIG. 7A illustrates a modification for this purpose, in which the separation distance $S_1$ in the overlapped-multicircle aperture of the fourth electrode $G_4$ is made slightly larger than the separation distance S in the third grid electrode $G_3$.

In practice, in the bi-potential type focusing electrostatic lenses, a converging lens is formed at the side of the third grid electrode $G_3$ applied with a converging potential (low potential side), and a diverging lens is formed at the side of the forth grid electrode $G_4$ applied with an anode potential (high potential side). In addition, since the large diameter electrostatic lens formed by the overlapped-multicircle aperture has its vertical aperture inner diameter smaller than the horizontal aperture inner diameter, the converging force in the vertical direction is larger that in the horizontal direction. Therefore, a beam spot formed on the phosphor screen is deformed to have a oblong circular section having a horizontal long axis. This inclination is remarkable particularly in the center electrostatic lens formed by the center opening 50G in comparison with those formed by the opposite side openings 50R and 50B, because the center opening 50G of the overlapped-multicircle aperture 50 has no partition at opposite sides in the opening arrangement direction so that the electrostatic lens formed by the center opening 50G has the converging force in the vertical direction greatly larger than that in the horizontal direction. In other words, the center electrostatic lens has a large astigmatism. This astigmatism can be dissolved by applying optimum covering potentials which are different between the horizontal direction and the vertical direction. However, this method is impossible because the main electrode member formed with the overlapped-multicircle aperture is charged to the same potential in whole.

Figure 8:
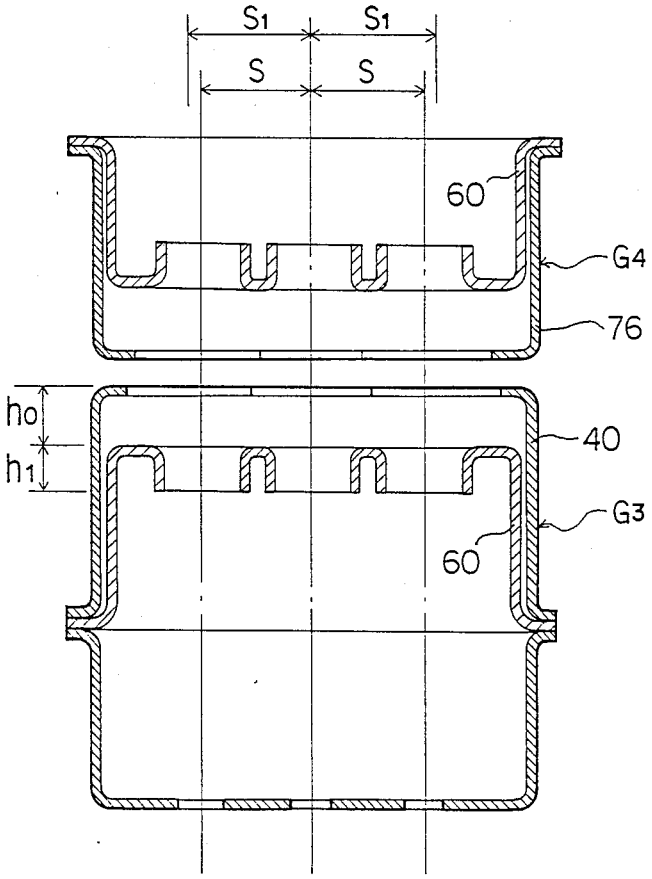
FIG. 8 is a view similar to FIG. 7 but illustrating another embodiment of the electrode assembly for an electrostatic lens in accordance with the present invention in combination with an electron gun for color cathode ray tube.

Referring to FIG. 8, there is shown a second embodiment of the electrode assembly in accordance with the present invention which can overcome the above problem. As will be apparent from comparison between FIGS. 7 and 8, the electrode assembly shown in FIG. 8 has third and fourth grid electrodes $G_3$ and $G_4$ each of which is composed of a combination of the main electrode member shown in FIG. 5 and the auxiliary electrode member shown in FIG. 6. In FIG. 8, therefore, portions similar to those shown in FIGS. 5, 6 and 7 are given the same Reference Numerals, and explanation will be omitted.

Figure 9:
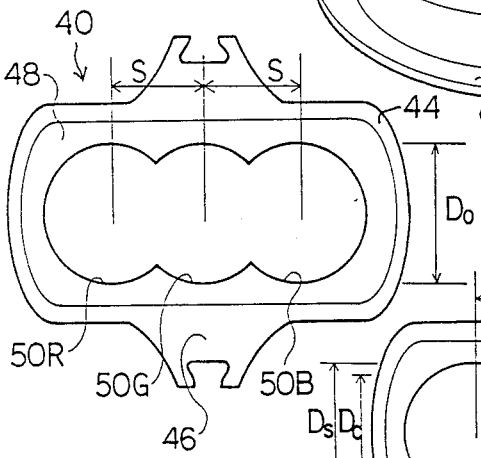
FIG. 9 is a top view of a main electrode member of the tubular electrode constituting the third grid electrode of the electrostatic lens shown in FIG. 8.
Figure 10:
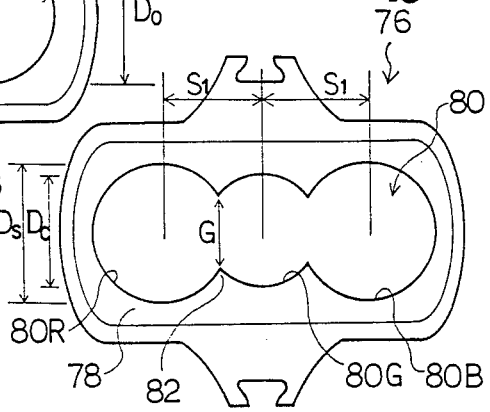
FIG. 10 is a view similar to FIG. 9 but showing a main electrode member of the tubular electrode constituting the fourth grid electrode of the electrostatic lens shown in FIG. 8.

Referring to FIG. 9, the main electrode member 40 incorporated in the third grid electrode $G_3$ has the end wall 48 formed with the overlapped-multicircle aperture consisting of three circular openings 50R, 50G and 50B which have their centers separated from each other by the separation distance S and also has the inner diameter $D_0$ larger than the separation distance S. On the other hand, the fourth grid electrode $G_4$ maintained at a potential higher than that of the third grid electrode $G_3$ comprises a main electrode member 76 as shown in FIG. 10, which has an end wall 78 formed with an overlapped-multicircle aperture 80 consisting of three circular openings 80R, 80G and 80B whose centers are separated from each other by a separation distance $S_1$ equal to or slightly larger than the aperture separation distance S in the third grid electrode $G_3$. The circular openings 80R, 80G and 80B have inner diameters larger than the separation distance $S_1$. But, the diameter $D_c$ of the center opening 80G is smaller than the diameter $D_s$ of the opposite side openings 80R and 80B, and the diameter $D_s$ is smaller than the diameter $D_0$ of the overlapped-multicircle aperture 50 in the third grid electrode $G_3$.

Thus, the relation in the aperture diameter and the separation distance between the main electrode members 40 and 76 of the third grid electrode $G_3$ and the fourth grid electrode $G_4$ can be expressed:

$$D_0 > D_s > D_c > S_1 \geqq S$$

In addition, each of the third and fourth grid electrodes $G_3$ and $G_4$ also comprises an auxiliary electrode member which has the same structure as that shown in FIG. 6 and whose independent collars are separated from each other by the separation distance S.

Thus, in the electrode assembly shown in FIG. 8, a large diameter electrostatic lens having an extremely small spherical aberration is formed between the third and fourth grid electrodes $G_3$ and $G_4$, similarly to the embodiment shown in FIG. 7.

In the embodiment shown in FIG. 8, however, since the openings 80R, 80G and 80B of the overlapped-multicircle aperture 80 in the fourth grid electrode $G_4$ are smaller than the opening 50R, 50G and 50B of the overlapped-multicircle aperture 50 in the third grid electrode $G_3$, the diverging lens formed at the side of the fourth grid electrode $G_4$ has a high diverging power in comparison with the case in which the openings 80R, 80G and 80B would have the same diameter as that of the openings 50R, 50G and 50B. On the contrary, the converging power, particularly in the vertical direction is weakened in comparison with the case in which the overlapped-multicircle aperture 80 of the fourth grid electrode $G_4$ would have the same dimension as that of the overlapped-multicircle aperture 50 of the third grid electrode $G_3$. Therefore, it is possible to make the optimum converging potential for the horizontal direction consistent with that for the vertical direction.

Furthermore, since the center opening 80G of the overlapped-multicircle aperture 80 in the fourth grid electrode $G_4$ is made to have the inner diameter $D_c$ smaller than that $D_s$ of the opposite side openings 80R and 80B, the vertical direction converging force for the electron beam passing through the center opening 80G can be weakened in comparison with the case having the openings 80R, 80G and 80B of the same inner diameter $D_s$. Therefore, if the diameter $D_c$ of the center opening 80G is appropriately selected, it is possible to reduce the vertical direction converging power for the center electron beam so that the optimum converging potential is made equal between the horizontal direction and the vertical direction. As a result, the electron beam converging power is made equal between the electrostatic lenses formed by the center and opposite side apertures, so that the oblong deformation of the beam spot is corrected so as to allow a circle spot to be formed on the phosphor screen. Namely, the astigmatism can be removed.

Additionally, since the diameter $D_c$ of the center opening 80G is smaller than those $D_s$ of the oppposite side openings 80R and 80B, the distance G in a narrow portion 82 formed at a junction between each pair of adjacent circular openings 80R-80G and 80G-80B can be made smaller than the case of the three circular openings 80R, 80g and 80B having the same diameter $D_s$. It is possible to increase the horizontal direction converging power of the center electrostatic lens, so that the action of the lenses can be made equal both in the horizontal direction and in the vertical direction. Therefore, the electrostatic lens of a high resolution can be obtained.

In the above mentioned embodiments, the auxiliary electrode member has the tubular casing 62 coupling between the flange 64 and the end wall 68 as shown in FIG. 6. But, the auxiliary electrode member is not limited to such a configuration, but can assume any configuration which can position a plate-like electrode provided with independent collar each forming a small-diameter electrostatic lens, at a predetermined position within the main tubular electrode member 40 separate from the distance $h_0$ from the end wall 48 formed with the overlapped-multicircle aperture 50.

Further, the electrode assembly in accordance with the present invention has been embodied in the bipotential type focusing electrostatic lens, but can be also applied to other electrostatic lens such as a multi-stage converging electrostatic lens.

The invention has thus been shown and described with reference to specific embodiments. However, it should be noted that the invention is in no way limited to the details of the illustrated structures but changes and modifications may be made within the scope of the appended claims.

I claim:

1. An electrode assembly for an electrostatic lens of the in-line type electron gun for a color cathode ray tube, which includes a pair of tubular electroces, wherein the improvement is that each of the tubular electrodes includes a main tubular electrode member closed at its one end by an end wall which has an aperture of the configuration obtained by partially overlapping a plurality of circular openings arranged in an inline manner, and an auxiliary electrode member fitted into the main electrode member and having an end wall position separate from the end wall of the main electrode member by a predetermined distance, the end wall of the auxiliary electrode member being formed with a plurality of independent collars projecting therethrough in parallel to the axial direction of the respective circular openings of the overlapped-multicircle aperture and to superpose the corresponding circular openings of the overlapped-multicircle aperture in an axial direction, the pair of tubular electrodes being located in such a manner that the end walls of the respective main tubular electrode members oppost each other and are separate from each other, each of the main electrode members having an overlapped-multicircle aperture composed of three circular openings, a high potential side tubular electrode of the tubular electrode pair having its overlapped-multicircle aperture composed of circular openings whose diameters are smaller than the diameters of the circular openings of the overlapped-multicircle aperture of a low potential side tubular electrode.

2. An electrode assembly as claimed in claim 1 wherein the center circular opening of the overlapped-multicircle aperture in the high potential side tubular electrode has a diameter smaller than that of the opposite side circular openings of the same overlapped-multicircle aperture.

3. As electrode assembly as claim 1 wherein the main electrode members and the auxiliary electrode members of the tubular electrode pair are provided with the overlapped-multicircle apertures and the independent collars which fulfil the following relation $$D_0 > D_s > D_c > S_1 \geqq S$$

where $D_0$ is the inner diameter of the respective circular openings of the overlapped-multicircle aperture of the main electrode member in a low potential side tubular electrode of the tubular electrode pair, $D_s$ is the inner diameter of opposite side circular openings of the overlapped-multicircle aperture of the main electrode member in a high potential side tubular electrode, $D_c$ is the inner diameter of the center circular openings of the overlapped-multicircle aperture of the main electrode member in a high potential side tubular electrode, $S_1$ is the separation distance of the three circular openings of the overlapped-multicircle aperture of the main electrode member in a high potential side tubular electrode, and S is the separation distance of the independent collars of the respective auxiliary electrode members of the tubular electrode pair and the three circular openings of the overlapped-multicircle aperture of the main electrode member in a low potential side tubular electrode.

4. An electrode assembly as claimed in claim 1 wherein the height of the independent collars of the auxiliary electrode member is not smaller than one third of the inner diameter of the independent aperture with collar.

5. An electrode assembly as claimed in claim 1 wherein the distance between the end wall of the main electrode member and the end wall of the associated auxiliary electrode member is in the range of one fifth to three fifth of the diameter of the circular opening of the overlapped-multicircle aperture of the main electrode member.

6. An electrode assembly as claimed in claim 1 wherein the main electrode member includes a tubular casing of a horizontally elongated rectangular section having a flange formed at one end thereof and closed at the other end thereof by an end wall, the end wall having an aperture of the configuration obtained by partially overlapping three circular openings arranged in a horizontally in-line manner, and wherein the auxiliary electrode member includes a tubular casing of a horizontally elongated rectangular section having a flange formed at one end thereof and closed at the other end thereof by an end wall, the dimension and height of the auxiliary electrode tubular casing being such that the auxiliary electrode casing is fitted into the main electrode casing with the end wall of the auxiliary electrode casing being positioned separately from the end wall of the main electrode casing by a predetermined distance, the end wall of the auxiliary electrode casing being formed with three horizontally arrayed independent collars projecting therethrough in parallel to the axial direction of the respective circular openings of the overlapped-multicircle aperture and to superpose the corresponding circular openings of the overlapped-multicircle aperture in the axial direction.

7. An electrode assembly for an electrostatic lens of the in-line type electron gun for a color cathode ray tube, said electrode assembly comprising a pair of tubular electrodes arranged in an opposing relationship in the axial direction of three electron beams passing through the electrostatic lens, each of the tubular electrodes including:

a main electrode member composed of a tubular casing of a horizontally elongated rectangular section having a flange formed at one end thereof and closed at the other end thereof by an end wall, the end wall having an aperture of the configuration obtained by partially overlapping three circular openings arranged in a horizontally in-line manner; and an auxiliary electrode member composed of a tubular casing of a horizontally elongated rectangular section having a flange formed at one end thereof and closed at the other end thereof by an end wall, the dimension and height of the ausiliary electrode tubular casing being such that the auxiliary electrode casing is fitted into the main electrode casing with the end wall of the auxiliary electrode casing being positioned separately from the end wall of the main electrode casing by a predetermined distance, the end wall of the auxiliary electrode casing being formed with three horizontally arrayed independent collars projecting therethrough in parallel to the axial direction of the respective circular openings of the overlapped-multicircle aperture and to superpose the corresponding circular openings of the overlaped-multicircle aperture in the axial direction, a high potential side tubular electrode of the tubular electrode pair having its overlapped-multicircle aperture composed of circular openings whose diameter is smaller than the diameters of the circular openings of the overlapped-multicircle aperture of a low potential side tubular electrode.

8. An electrode assembly as claimed in claim 7 wherein the center circular opening of the overlapped-multicircle aperture of the main tubular electrode member in any one of the pair of tubular electrodes is coaxial with the center collar of the associated auxiliary electrode member, but the opposite side circular openings of the overlapped-multicircle aperture have their centers slightly outwardly shifted from the center axes of the corresponding collars of the associated auxiliary electrode member.

9. An electrode assembly as claimed in claim 7 wherein the center circular opening of the overlapped-multicircle aperture in the high potenial side tubular electrode has a diameter smaller than that of the opposite side circular openings of the same overlapped-multicircle aperture.

10. As electrode assembly as claim 7 wherein the main electrode members and the auxiliary electrode members of the tubular electrode pair are provided with the overlapped-multicircle apertures and the independent collars which fulfil the following relation $$D_0 > D_s > D_c > S_1 \geqq S$$

where $D_0$ is the inner diameter of the respective circular openings of the overlapped-multicircle aperture of the main electrode member in a low potential side tubular electrode of the tubular electrode pair, $D_s$ is the inner diameter of opposite side circular openings of the overlapped-multicircle aperture of the main electrode member in a high potential side tubular electrode, $D_c$ is the inner diameter of the center circular openings of the overlapped-multicircle aperture of the main electrode member in a high potential side tubular electrode, $S_1$ is the separation distance of the three circular openings of the overlapped-multicircle aperture of the main electrode member in a high potential side tubular electrode, and S is the separation distance of the independent collars of the respective auxiliary electrode members of the tubular electrode pair and the three circular openings of the overlapped-multicircle aperture of the main electrode member in a low potential side tubular electrode.

11. An electrode assembly as claimed in claim 7 wherein the height of the independent collars of the auxiliary electrode member is not smaller than one third of the inner diameter of the independent aperture with collar.

12. An electrode assembly as claimed in claim 7 wherein the distance between the end wall of the main electrode member and the end wall of the associated auxiliary electrode member is in the range of one fifth to three fifth of the diameter of the circular opening of the overlapped-multicircle aperture of the main electrode member.

* * * * *